US006968861B2

(12) United States Patent
Judge et al.

(10) Patent No.: US 6,968,861 B2
(45) Date of Patent: Nov. 29, 2005

(54) GRAVITATIONAL SAFETY VALVE FOR MATERIAL DELIVERY SYSTEMS

(76) Inventors: Kerry J. Judge, 3740 Irwin St., E., Safety Harbor, FL (US) 34695; Timo E. Rantikallio, Olarsvag 7, Langshyttan (SE) 770 70

( * ) Notice: Subject to any disclaimer, the term of this patent is extended or adjusted under 35 U.S.C. 154(b) by 125 days.

(21) Appl. No.: 10/610,121

(22) Filed: Jun. 30, 2003

(65) Prior Publication Data

US 2004/0004092 A1 Jan. 8, 2004

Related U.S. Application Data

(60) Provisional application No. 60/392,903, filed on Jul. 1, 2002.

(51) Int. Cl.[7] ..... F16K 31/126; F16K 13/00
(52) U.S. Cl. ..... 137/624.11; 251/5
(58) Field of Search ..... 137/223, 225, 137/226, 624.11; 251/5, 61.1, 61; 222/380

(56) References Cited

U.S. PATENT DOCUMENTS

| | | | | |
|---|---|---|---|---|
| 2,317,376 | A * | 4/1943 | Grove et al. | 251/5 |
| 2,590,215 | A * | 3/1952 | Sausa | 251/5 |
| 5,147,182 | A * | 9/1992 | Timmons | 417/234 |
| 6,691,786 | B2 * | 2/2004 | Patel | 251/61.1 |
| 6,817,591 | B2 * | 11/2004 | Lehnhardt et al. | 251/5 |

* cited by examiner

*Primary Examiner*—Kevin Lee

(57) ABSTRACT

A valve apparatus for controlling the discharge of material pumped by a material pump through a discharge hose, wherein the valve apparatus includes a substantially sealed flexible bladder in a casing to be located about a discharge hose, and a source of compressed air. Material flow through the discharge hose is prevented by introducing compressed into the flexible bladder, causing the bladder to expand and constrict the discharge hose, and the flow of material is resumed by deflating the bladder. Simultaneous control of the material pump and the valve apparatus is also achieved by the present invention.

31 Claims, 9 Drawing Sheets

GRAVITATIONAL SAFETY VALVE FOR MATERIAL DELIVERY SYSTEMS

CROSS-REFERENCE TO RELATED APPLICATION

The present application claims the benefit of previously filed co-pending Provisional Patent Application, Ser. No. 60/392,903 filed Jul. 1, 2002.

FIELD OF THE INVENTION

The present invention relates to the field of flow control systems for material delivery systems, which use pumps. More specifically, it relates to systems which control the delivery of slurry materials, such as concrete, to a specific destination by use of a novel valve system on the discharge tubing which is located downstream of the pumping mechanism. It relates to a flexible bladder located about the perimeter of the slurry discharge tubing, where the bladder can expand by being inflated to cause a constriction in the discharge tubing that prevents the flow of materials through the tubing. It also relates to the control of such a bladder in conjunction with the control of the material pump, and optionally includes the use of a time-delay control circuit in such control. Finally, it relates a novel connector to be placed in-line between the material pump control switch and a standard material pump, where such connectors allow for such combined control of the present invention with the material pump.

BACKGROUND OF THE INVENTION

In the concrete pouring business, it is typical to utilize concrete boom pump trucks for large-scale jobs. A typical concrete boom pump truck contains a series of booms that allow the concrete to be delivered great distances away from the pump truck. A universal problem in the use of boom pump trucks is the absence of any method or device to adequately control the flow of concrete from the boom to the intended destination A typical boom pump truck is depicted in FIG. 1, and includes a concrete pump and a series of booms. In use, a typical arrangement includes three boom segments that extend upwardly from the pump truck to an apex, followed by one boom segment that extends downwardly from the apex. At the end of the last boom segment there is often a discharge delivery hose, often referred to as a "tip hose," from which the concrete exits to its destination.

A common concrete pumping scenario requires that a large number of discrete holes be filled with concrete, as may be needed during the pouring of pilings in a foundation. For such a situation, it is typical to have one operator whose job it is to control both the operation of the concrete pump and the location of the boom, and a second operator whose job is to handle the tip hose and hold it in position above the destination intended for the concrete. Specifically, the pump operator will position the boom such that the tip hose is directly above the hole to be filled. The pump operator will turn the pump on, causing concrete to flow up the first two sections of the boom system, past the apex, down the next two sections of the boom, and out the tip hose into the hole. All the while, the tip hose operator will handle the tip hose. Once the hole is close to being filled, the tip hose operator signals the pump operator to turn the pump off. At this point, all of the concrete that is below the apex in the boom system will fall, by force of gravity, down the third and forth sections of the boom, out the tip hose, and into the hole. The pump operator will then move the boom, while the tip hose operator accompanies it to the next destination, and the process will start over.

As can be appreciated by the foregoing, it is important that the operation of the pump be synchronized with the placement of the tip hose. Presently, this translates into the pump operator and the tip hose operator having to work in unison. Specifically, the pump operator must be careful to not start the pump, and thus begin pumping concrete, until the tip hose operator is ready with the tip hose in position. Likewise, after a hole is filled, the tip hose operator must be careful not to move the tip hose away from the hole or other destination until all of the concrete below the apex has fallen, and the tip hose is empty.

In addition to the need for working close together with the tip hose operator, the pump operator must also be adept at judging exactly when to turn the pump off. Specifically, it is often difficult for the pump operator to accurately estimate the specific time to turn the pump off, such that the amount of concrete in the system below the apex will be sufficient to fill the hole. Rather, it is common for the pump operator to turn the pump off too soon, resulting in the hole not being completely filled, or alternatively, to turn the pump off too late, resulting in concrete overflowing the hole. These challenges are made even more difficult by the fact that the boom system contains a large amount of heavy concrete. Once the pump is turned off, the draining of the boom system from the apex downward causes the entire boom system to lift vertically as the concrete empties, thus making it even more difficult to judge exactly when to turn the pump off to result in the precise amount of concrete being pumped. This movement also increases the challenge that the tip hose operator faces in controlling the tip hose.

An obvious shortcoming that has not been solved by the prior art, is the pump operator's need to estimate the specific amount of concrete that is beyond the apex, and thus available to flow out of the tip hose, at the time he turns the pump off. A device is needed which will allow the pump operator more accurate control of the amount of concrete delivered during a given cycle.

It is known in the prior art to reduce the variability in the amount of concrete delivered by having the tip hose operator put a "kink" in the tip hose when the operator desires to stop the flow of concrete. Of course, such an action must be taken only in conjunction with the pump operator turning the pump off, as to fail to do so could result in the tip hose operator having to overcome the force of the concrete being pumped when attempting to place a kink in the tip hose. Placing a kink in the tip hose when the concrete pump is still running is a very dangerous situation, and can result in a catastrophic failure of the tip hose under pressure. A device is needed which will provide increased control of the amount of concrete delivered which does not incur the additional risks of a ruptured tip hose.

Other devices are known to control the flow of concrete in a flexible hose. For instance, in U.S. Pat. No. 5,105,981, issued to Gehman, is disclosed a particulate matter dispenser. Included in the dispenser is a flexible discharge tube at the base, which permits particulate matter to flow out of the dispenser. The flexible tube extends through an aperture in a base plate. One face of the aperture has a projecting portion, which constitutes a fixed clamp. This fixed clamp cooperates with a moveable clamp connected to a linkage, and this allows the user to open and close the flexible tube. In order to permit the flow of material at certain designated times, the linkage is actuated, causing the flexible clamp to be moved away from the fixed clamp and thus decompress the hose, thereby allowing flow through the hose until the flexible clamp is returned.

Similarly, U.S. Pat. No. 4,893,966, issued to Roehl, discloses a component which serves to squeeze a hose containing a granular dry material, thus preventing the flow of the material through the hose. The hose squeezing means consists of rounded elongated squeezing elements which are arranged parallel to each other on either side of the hose. One of the two squeezing elements is connected via a fork shaped linkage to a piston rod which drives the element into the path of the hose, while the other element is connected to the housing of the working cylinder.

Although the discharge tube control devices may be appropriate for large pieces of heavy equipment, they are too heavy and difficult to move to be of any use in conjunction with a boom pump truck.

One device known in the prior art is disclosed German Patent No. DE 33 10 176 C2, issued to Bylund, discloses a mouth piece for the delivery of concrete, and other semi fluid materials of particular use, in pumping concrete under water. Specifically, there is disclosed a system consisting of two rigid pipes in axial succession, connected by a flexible tube. This combination is surrounded by an outer pipe, with space between the inner pipes and tube on the one hand, and the outer pipe on the other hand, is pneumatically sealed and connected to a pressure medium. By pumping air into the cavity, the flexible tube is compressed, thus preventing the flow of concrete through it.

There is also disclosed in the Bylund patent, support strips arranged on the inside of the outer pipe, and leading to the outer periphery of the flexible tube, which serves a purpose of insuring that the flexible tube remains in exactly its cylindrical, relaxed position when the valve is opened. An alternative embodiment is disclosed, wherein the support strips are replaced with a continuous pipe located about the periphery of the flexible tube. This peripheral pipe includes large openings which allow air to pass, and therefore act open, the flexible tube when it is desired to prevent the flow of material.

One drawback of the device disclosed in the Bylund patent, is that it is very heavy. As a result, it adds increased strain on the boom system. Another drawback is that the flexible mechanism is exposed to the concrete or other slurry material. This drawback, in combination with the fact that the pressure medium acts directly upon it, is likely to result in the flexible hose wearing out quickly. Replacement of the flexible hose would require disassembly of the device. There is a need for a system wherein the hose for conveying the concrete is not acted upon directly by the pressure medium.

OBJECTS AND SUMMARY OF THE INVENTION

It is an object of the present invention to provide an apparatus to control the flow of material that is being pumped to a desired destination, while at the same time improving the safety and efficiency of the pumping process.

It is an object of the present invention to provide an apparatus which is lightweight and self-contained, such that it may be conveniently used on tip hoses attached to booms on a boom pump truck.

It is also an object of the present invention to provide such an apparatus which, in controlling the flow of such materials, reduces or altogether prevents the possibility of accidental discharge of the material in the event of any loss of power or control signal failure.

It is an object of the present invention to provide such an apparatus including a means by which the valve system may be quickly and safely opened prior to beginning the flow of material to be discharged.

It is an object of the present invention to provide a device which aids in keeping the work site clean and orderly by preventing the discharge of concrete to unintended locations.

It is also an object to provide a flow control device that includes delay elements which ensure that the valve system controlling the discharge of the material being pumped is opened prior to the pump being engaged. It is also an object of the present invention to include a means to conveniently bypass such delay element by making a simple adjustment in the field.

It is an object of the present invention to provide an apparatus to control the flow of a material through a discharge hose, where that apparatus can be periodically repositioned about the discharge hose so as to minimize the wear on any single portion of the discharge hose.

At its most general level, the preferred embodiment of the present invention, may be best understood by considering its three main sub-assemblies: (1) an inflatable bladder, located about the perimeter of a material pump discharge hose, or "tip hose"; (2) a control unit, for controlling a pressure medium, such as the flow of compressed gas (for example air) to and from the inflatable bladder as desired, thereby controlling the flow of material through the discharge hose; and (3) an electrical connecting device, located between a standard material pump control switch and the material pump solenoid, to intercept the signals from the pump control switch, and redirect such signals to the control unit, before returning them to the material pump, thereby introducing simultaneous operation of the pump and the valve system of the present invention.

First, according to the present invention, there is provided an inflatable bladder mechanism which is to be installed about the outside perimeter of a discharge hose that is located downstream of a material pump. In short, the inflatable bladder receives compressed air from a supply of compressed air until the bladder is inflated. Because it is located about the perimeter of the material pump discharge hose, the inflated bladder causes a constriction of the discharge hose, thereby preventing material flow through the discharge hose. Conversely, by deflating the bladder, the constriction is removed, thus permitting material flow through the discharge hose and to its intended destination.

A control unit controls the inflation and deflation of the bladder. More specifically, there is provided a pneumatic control valve to control the flow of compressed air from the compressed air supply to the bladder. When it is desired to inflate the bladder, the pneumatic control valve is positioned to allow air to flow to the bladder. When it is desired to deflate the bladder, the pneumatic control valve is positioned to allow air to flow from the bladder; a quick exhaust valve placed in pneumatic connection with the bladder increases the speed of the deflation process.

Also according to the present invention, there is provided a timer delay circuit within the control unit, which allows the user of the present invention to ensure that the bladder mechanism is in the "open" position sufficiently, in advance of the material pump engaging. Such timer delay provides substantial safety and flow control benefits as explained herein. There is also a means to bypass such timer delay, should the user wish to do so.

Also according to the present invention, there is disclosed a novel solenoid connector to be located in-line between a pump control switch and a pump. This novel connector allows the pump's on/off signal to be intercepted from the material pump control, redirected to the pneumatic control valve of the present invention, and then re-routed to the material pump signal input. Through the use of this novel connector, a material pump operator may control the operation of the material pump, simultaneously with the control of the valve system of the present invention, by activating just one switch.

These and other objects and advantages of the present invention will become apparent from the following detailed description when viewed in conjunction with the accompanying drawings, which set forth the preferred embodiments of various aspects of the invention.

BRIEF DESCRIPTION OF THE DRAWINGS

The invention will now be described, with respect to the drawings in which.

DESCRIPTION OF THE PREFERRED EMBODIMENT

Figure 1:
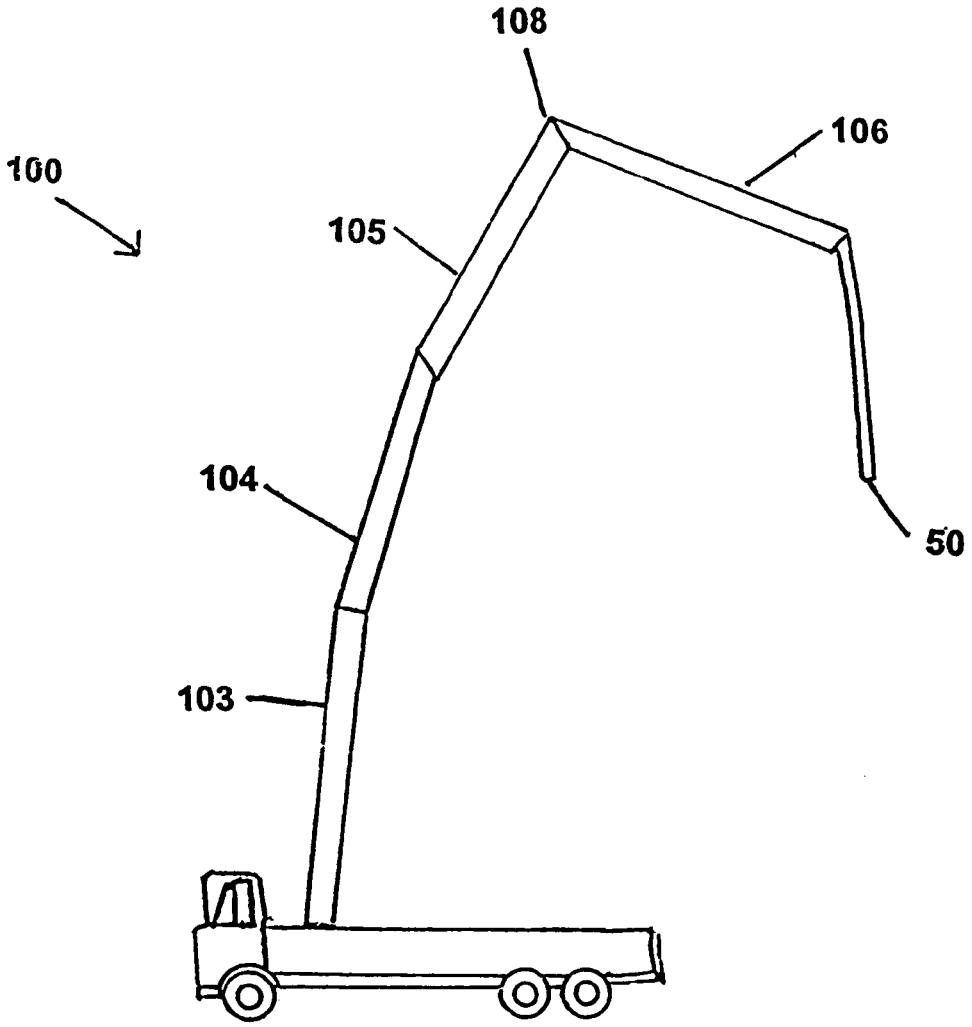
(PRIOR ART) FIGURE 1
FIG. 1 depicts a typical boom pump truck with a tip hose extending from the discharge end of the boom.

The present invention will now be described more fully hereinafter, with reference to the accompanying drawings, in which preferred embodiments of the invention are shown. It will be understood that the components of the presently preferred embodiments of the present invention, as generally described and illustrated in the figures herein, could be arranged and designed in a wide variety of different configurations. Thus, this invention may be embodied in many different forms and should not be construed as limited to the embodiments set forth herein. Rather, these embodiments are provided so that this disclosure will be thorough and complete, and will fully convey the scope of the invention to those skilled in the art, and will be merely representative of the presently preferred embodiments of the invention. Like reference characters indicate corresponding parts throughout the several views of the drawings.

1. Major Sub-Assemblies

As discussed above, the preferred embodiment of the present invention may best be understood by first considering the major sub-assemblies which make it up. These sub-assemblies include a valve assembly, by-passable timer delay control, and a novel solenoid connector that connects the present invention to an existing boom pump control system on a boom pump truck. Before discussing these subassemblies, it is helpful to review the setup of a typical boom pump truck.

In its typical use, the preferred embodiment of the present invention is used in conjunction with a boom pump truck of the type depicted in FIG. 1. A typical boom pump truck 100, without the present invention incorporated, has mounted thereon, a boom system comprised of various sections 103–106, and a discharge hose 50, all of which permit the pumping of the material to its intended destination. In use, the material is pumped through boom sections 103, 104, and 105 to an apex 108. Once the material reaches apex 108, it falls by gravity flow through section 106, then through discharge hose 50 to its intended destination. Also located on a typical boom pump truck 100 is a compressed air supply (not shown).

A. Valve Assembly

Figure 2:
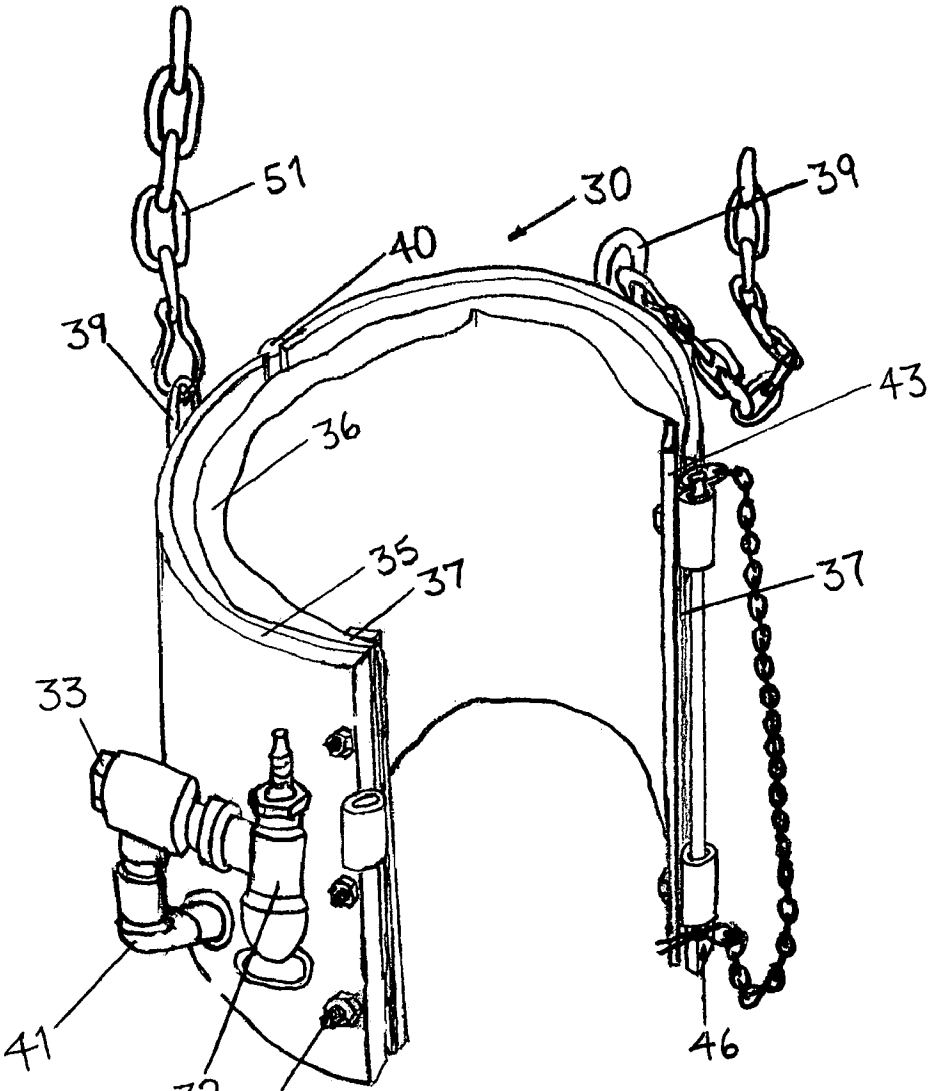
FIG. 2 depicts the valve assembly of the preferred embodiment in isolation.
Figure 3:
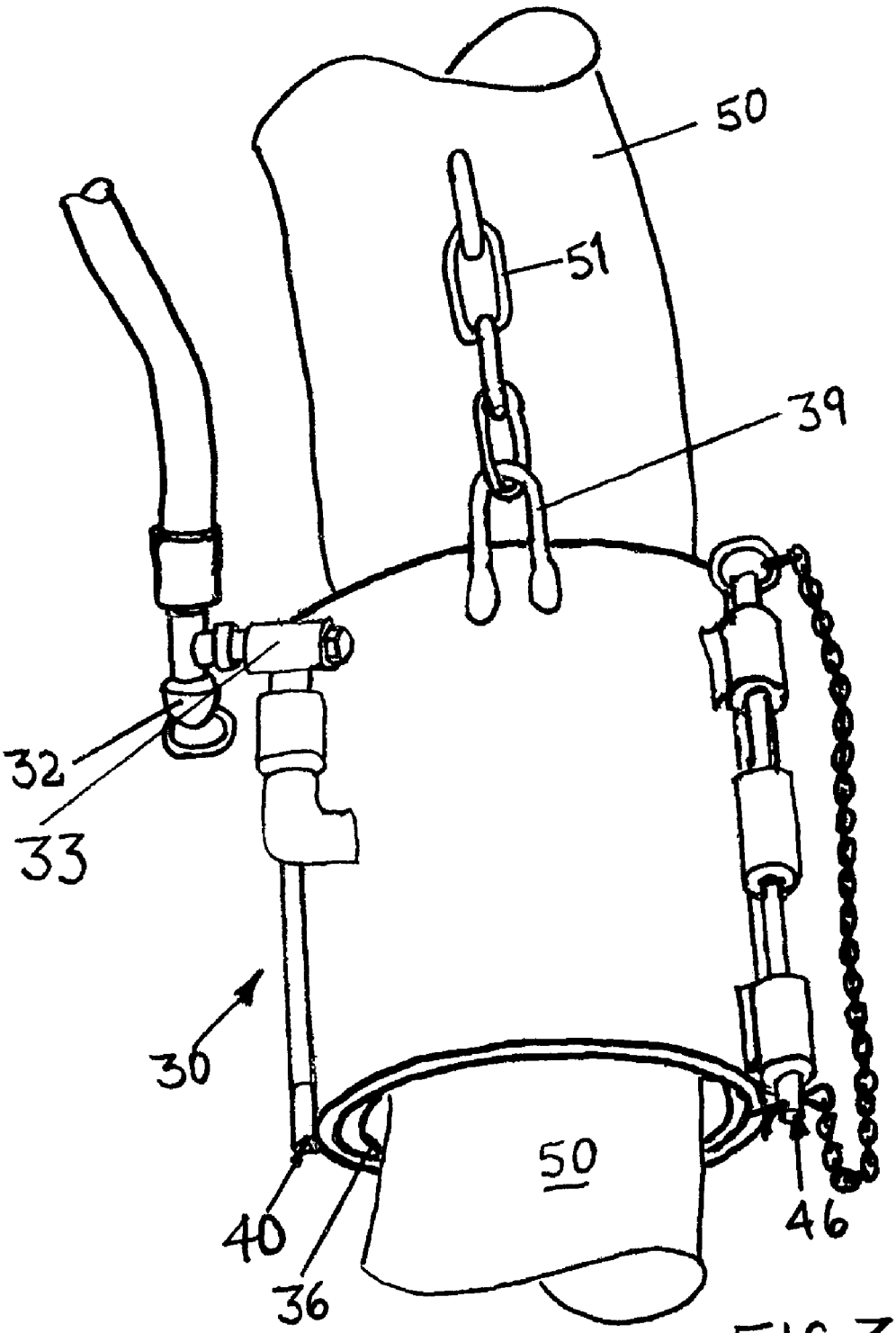
FIG. 3 depicts the valve assembly of the preferred embodiment affixed to a discharge hose.

The first major subassembly of the present invention is hose cuff 30, including an inflatable bladder 36, as shown in FIGS. 2 and 3. Inflatable bladder 36 is constructed of a flexible material, such as rubber or other suitable material. Inflatable bladder 36 is sized such that when it is filled with air, it expands within hose cuff casing 35 and constricts material discharge hose 50, thus substantially blocking the flow of concrete or other slurry material through slurry discharge hose 50. It should be noted that the present invention does not include the discharge hose but is instead intended to work in conjunction with an existing discharge hose. When the air within inflatable bladder 36 is released, inflatable bladder 36 retracts back to the inner perimeter of hose cuff casing 35, thus allowing the slurry material to flow largely unobstructed through discharge hose 50 to its destination. The various components of the airflow system of the present invention are connected by pneumatic tubing in conjunction with fittings as is well known in the art, including quick disconnect fittings where appropriate.

Within hose cuff casing 35 is located inflatable bladder 36, which is generally tube shaped, such as a length of hose. In the preferred embodiment, inflatable bladder 36 is five-inch I.D. lightweight water discharge hose, made of extruded SBR, and reinforced with multiple plies of polyester, model SS-115, manufactured by Titan Industries of South Gate, Calif. However, any material and configuration capable of retaining pressurized air, sufficient to withstand the force of concrete in a slurry discharge hose, would suffice and fall within the scope of the present invention.

In the preferred embodiment, hose cuff casing 35 substantially surrounds inflatable bladder 36, and is manufactured of a rigid material, for example stainless steel or other metals. The preferred embodiment of hose cuff casing 35 is approximately seven inches in diameter and nine inches in longitudinal length, yet the entire hose cuff assembly 30 weighs only approximately 16 pounds. As such, it is extremely lightweight and introduces little strain on the boom assembly.

Figure 4B:
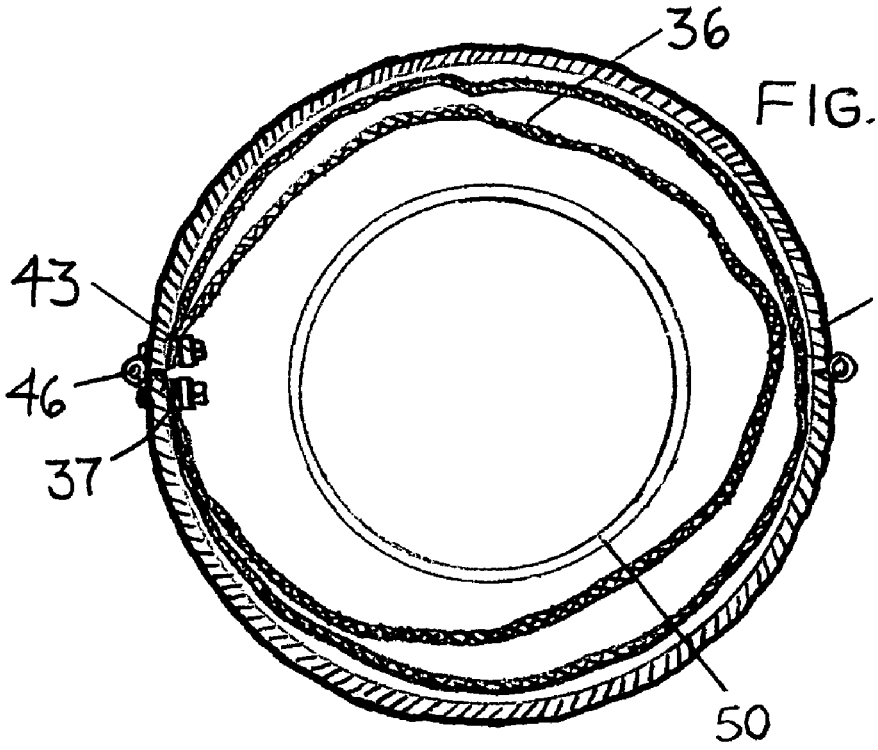
FIG. 4*b* depicts the valve assembly and a discharge hose as seen from the longitudinal direction with inflatable bladder inflated.
Figure 4A:
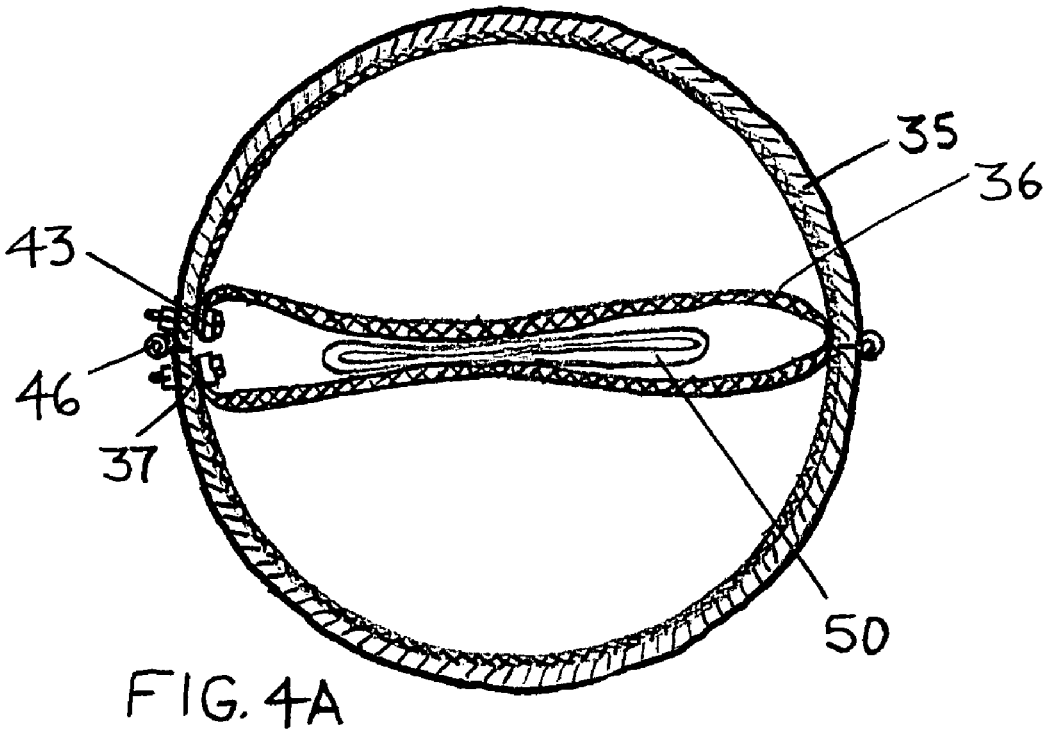
FIG. 4*a* depicts the valve assembly and a discharge hose as seen from the longitudinal direction with inflatable bladder deflated.

In the preferred embodiment, both ends 37 of generally tube-shaped inflatable bladder 36 are sealed by being held flat and substantially airtight against the inside of hose cuff casing 35 by the use of sealing plates 43 and fasteners 42. In this configuration, as shown in FIG. 4*a,* inflatable bladder 36 forms a ring as seen from longitudinal direction of hose cuff casing 35. When compressed air is introduced into inflatable bladder 36, through inflatable bladder inlet 41, inflatable bladder 36 expands, as shown in FIG. 4*b,* and creates a constriction in discharge hose 50, as discussed above.

The ability to locate hose cuff assembly 30 of the preferred embodiment at different positions on the length of discharge hose 50 can best be understood with reference to FIG. 3. Hose cuff casing 35 includes mounting brackets 39 capable of accepting support means 51. In the preferred embodiment, support means 51 are a set of chains which are connected to the boom of the concrete delivery system (not shown). By increasing or decreasing the number of links in the chains, the hose cuff assembly 30 can be located at differing positions over time along the length of slurry discharge hose 50. Such occasional repositioning allows the life of discharge hose 50 to be extended, as any stress that might be placed on it by the contraction of inflatable bladder 36 may be spread over different locations.

Figure 5:
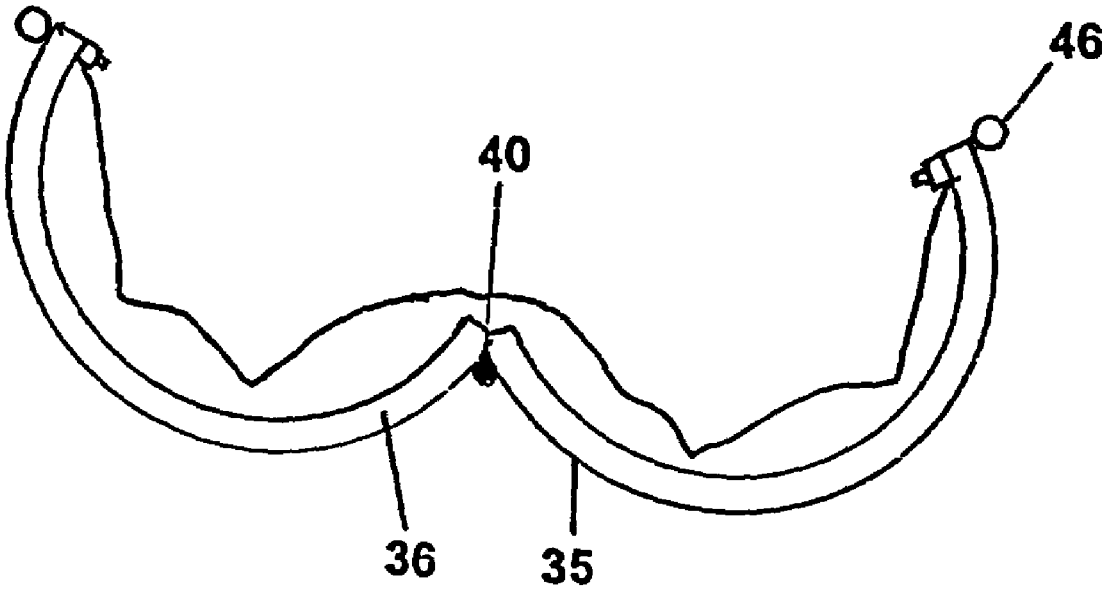
FIG. 5 depicts the valve assembly in isolation with the lockpin mechanism removed and the assembly opened for repositioning about a discharge hose.

As shown in FIG. 5, the repositioning process is aided in the preferred embodiment by hose cuff casing 35 comprising two sections, with a hinge 40 connecting them together on one portion of the hose cuff casing, and a lock pin assembly 46 holding another portion of the two pieces of the hose cuff casing together. In the preferred embodiment, the hinge 40 and the lock pin assembly 46 are located on approximately opposite sides of the hose cuff casing 35.

B. Circuitry

Figure 6:
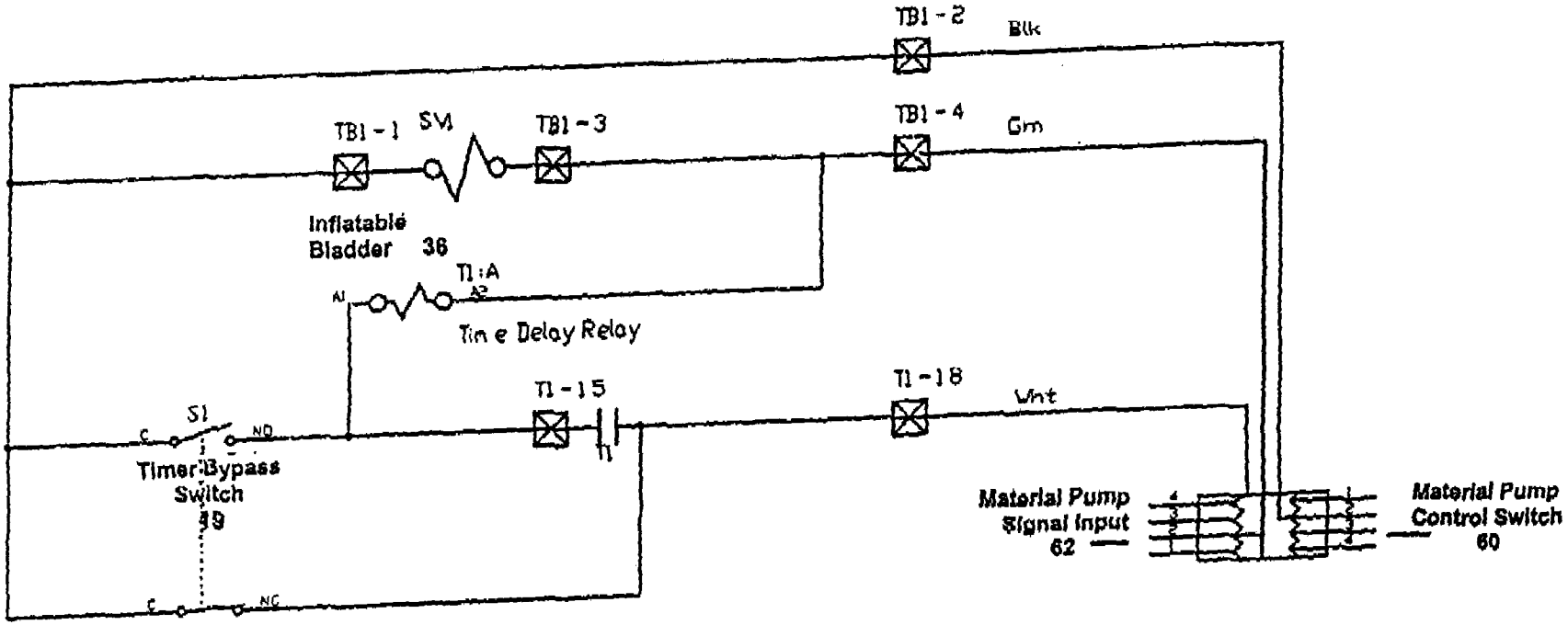
FIG. 6 depicts a schematic diagram of the circuitry of the present invention.

The second major subassembly of the present invention concerns the circuitry, which allows for simultaneous control of the valve system and the material pump. The circuitry of the preferred embodiment is shown schematically in FIG. 6. As can be appreciated in with reference to FIG. 7, there is a block diagram which aids in understanding the circuitry of the preferred embodiment of the present invention. Specifically, material pump control switch 60 is in electrical connection with pneumatic control valve solenoid 7, which controls pneumatic control valve 11. The circuit is completed by electrical connection back to material pump signal input 62, which controls the material pump (not shown). In addition, material pump control switch 60 is also in electrical connection with electrical timer 23, which adds a short delay, and the delay circuit is completed by electrical connection with material pump signal input 62.

By adding a delay, it is ensured that pneumatic control valve 11 releases air from inflatable bladder 36, sufficiently in advance of the activation of material pump (not shown) to ensure that the constriction in discharge hose 50 is removed before concrete or other material is pumped to discharge hose 50. As will be discussed in greater detail below, this delay provides distinct safety and housekeeping advantages. In the preferred embodiment, the delay added by electrical timer 23 is approximately 5 seconds, although those skilled in the art will recognize that shorter or longer delays may be appropriate based upon the material to be pumped, the distance which the material is to be pumped, and other parameters.

Despite the benefits of introducing a delay, there are certain situations well known to those in the art in which it would be advantageous to not have any delay in the material delivery process. As such, there is also included a timer bypass switch 19, which allows the operator to choose between introducing a delay to the signal sent to material pump (not shown), or not introducing a delay, depending upon the position of the switch. Specifically, timer bypass switch 19 is in electrical connection with material pump signal input 62 and electrical timer 23. When timer bypass switch 19 is set in the timer bypass (or "no delay") position, the signal can be sent directly to material pump (not shown). Alternatively, when timer bypass switch 19 is set in the "delay" position, signal from material pump control switch 60 is sent to electrical timer 23, and then to material pump (not shown).

C. Pneumatic Solenoid Connector

Figure 8:
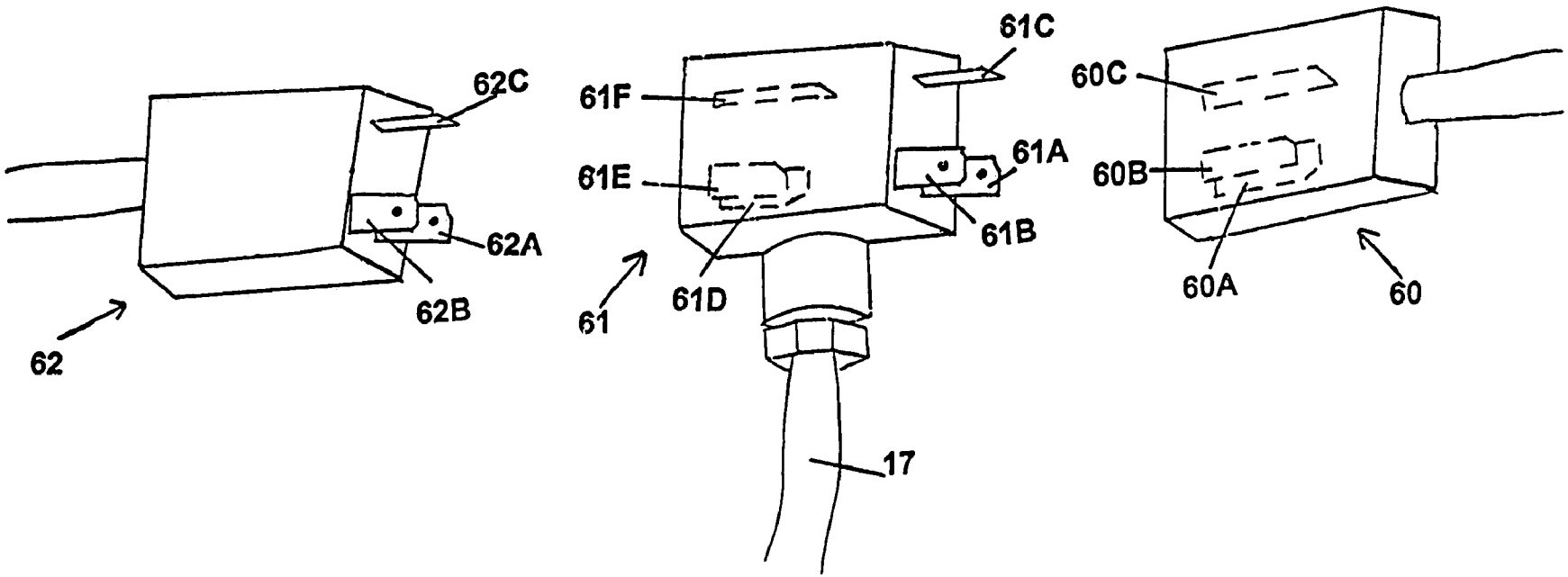
FIG. 8 depicts the 3-pinned pneumatic solenoid connector of the present invention as shown in relation to typical material pump control switch and material pump signal input connections.

The third major subassembly of the present invention is a novel solenoid connector that allows the valve system of the present invention, with is associated circuitry, to be conveniently connected to the connections available on a typical boom pump truck It concerns a simple, completely enclosed, error-proof pneumatic solenoid connector which intercepts the signal from material pump control switch 60 to material pump signal input 62, and redirects it to the valve system of the present invention The preferred embodiment of the pneumatic solenoid connector may be better understood with reference to FIG. 8. In a typical material pump, there is included material pump control switch 60 which typically has three female slots for accepting three corresponding male pins from material pump signal input 62. Specifically, material pump control switch 60 usually has a female positive pin 60A, a female negative pin 60B, and a straight "line-up" pin 60C. Correspondingly, material pump signal input 62 typically has a male positive pin 62A, a male negative pin 62B, and a straight "line-up" pin 62C, each of which is configured to match up with the female pins of material pump control switch 60.

In the preferred embodiment, the pins of pneumatic solenoid connector 61 mirror this arrangement of pins, allowing for simple installation inline on an existing pump control system. Specifically, there is disclosed a rectangular housing unit which has a male positive pin 61A, a male negative pin 61B, and a male line-up pin 61C on one side of solenoid connector 61, each of which lines up with the corresponding female pins on material pump control switch 60. On the opposite side of the housing unit are a female positive pin 61D, a female negative pin 61E, and a female line-up pin 61F, which, in turn, line up with the corresponding male pins on material pump signal input 62.

By having the various pins of solenoid connector in electrical connection with various components of the valve system of the present invention as described herein, there is achieved simultaneous control of the valve system and the pump system as discussed in the previous section above. Specifically, male positive pin 61A is in electrical connection with pneumatic control valve solenoid 7, electrical timer 23, timer bypass switch 19, and female positive pin 61D. Female negative pin 61E is in electrical connection with male negative pin 61B and pneumatic control valve solenoid 7. As is known to those in the art, the above connections are adequately made in a variety ways through the use conductive wires 17 and terminal blocks 18.

It is also common in the industry for the connection between material pump control switch 60 and material pump signal input 62 to utilize four pins, rather than three. As such, an alternative embodiment of the solenoid connector of the present invention likewise has four terminals on each side. In this embodiment, the pins are arranged in a square configuration relative to each other, and the body of solenoid connector 61 is square-shaped rather than rectangular.

Figure 9:
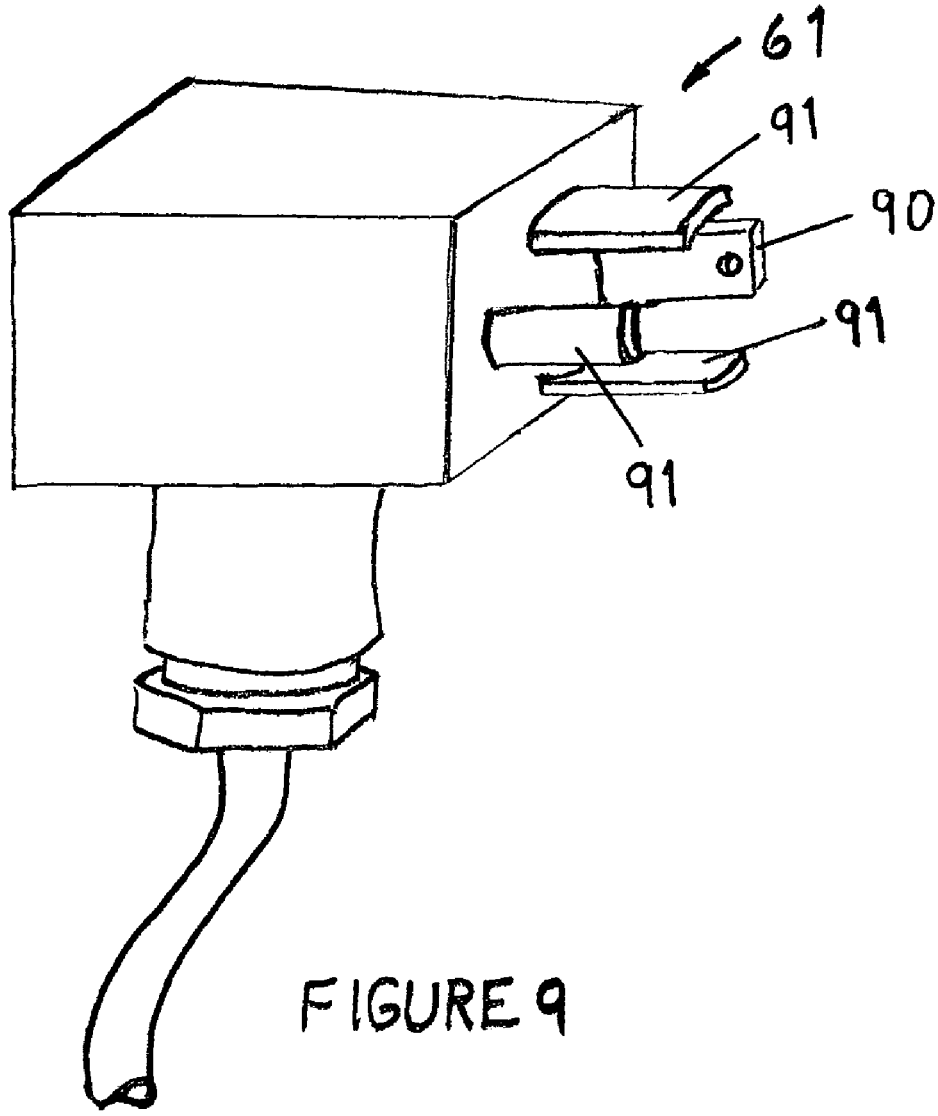
FIG. 9 depicts the 4-pinned pneumatic solenoid connector of the present invention.

As a result, users will immediately know by its shape that it is appropriate for use on a material pump having a similar wiring connector, thus reducing the likelihood of using the wrong connector. Moreover, the preferred embodiment of solenoid connector 61 of the present invention, includes an additional safety feature in that one of the male prongs 90 and female terminals (not shown) are physically straight, while the remaining three prongs 91 have a slight curve inward. As a result, a user is prevented from incorrectly hooking the solenoid connector 61 to the existing machinery through carelessness. Such alternative embodiment may be seen with reference to FIG. 9.

Both of the above embodiments may work with pneumatic control valve solenoids operating on either 12 or 24 volts; and systems employing these or other voltages fall within the scope of the present invention.

2. Use of the Present Invention

Figure 7:
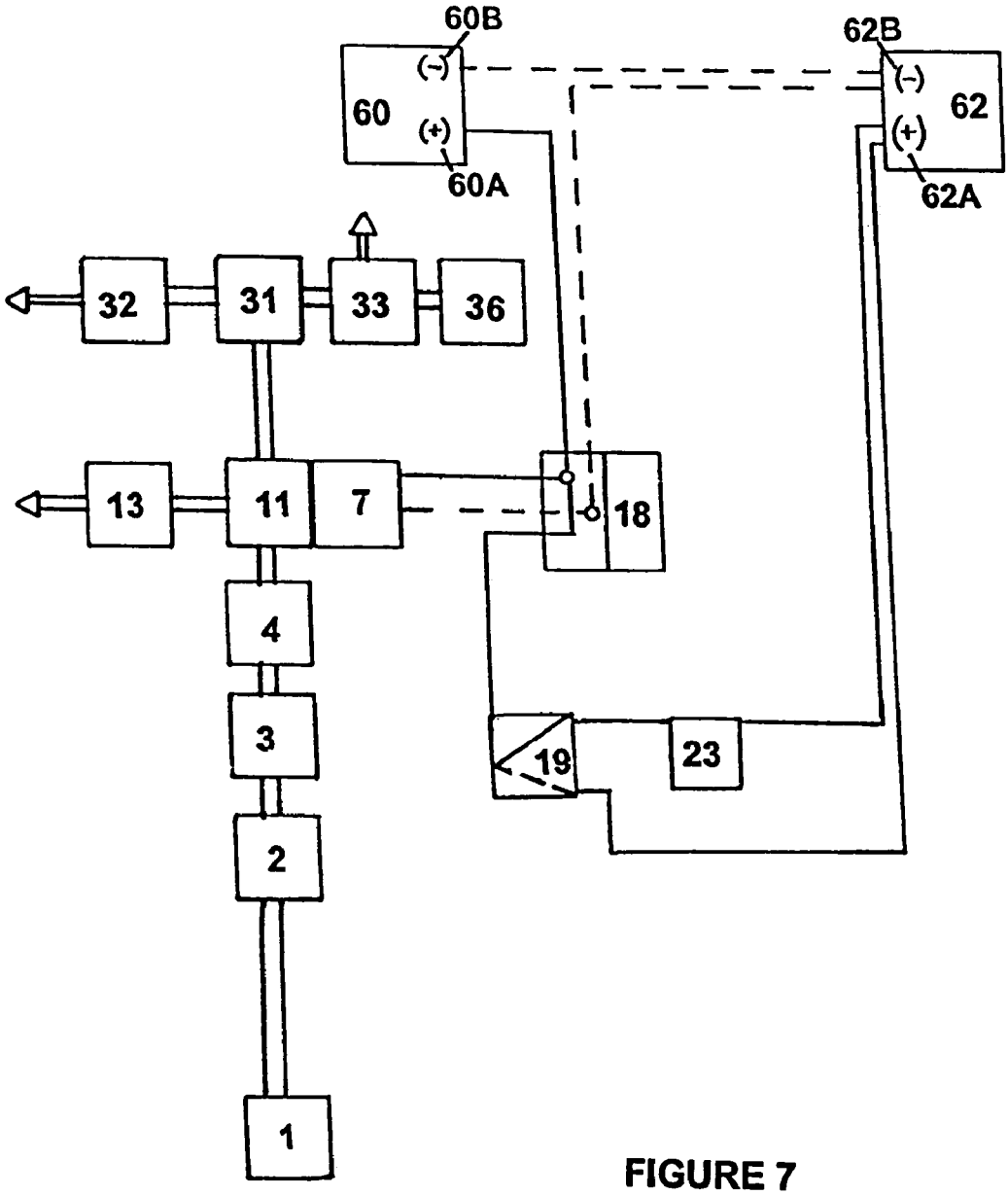
FIG. 7 depicts a block diagram of the circuits and pneumatic control system.

The advantages of the present invention may be best appreciated by considering its use during a material pumping cycle. Specifically, the reader may consider the process of delivering concrete to a specific location, such as into a pre-formed hole, using a pump truck in conjunction with a boom assembly. The process will be described starting from the point in the cycle at which the user is ready to open the valve system of the present invention, and pour concrete to an intended location (for example a hole to receive a piling). At this point in the process, the material pump (not shown) is "off," the boom assembly is filled with concrete to the point of hose cuff assembly 30, and inflatable bladder 36 is filled with pressurized air, thus preventing concrete from falling through concrete discharge hose 50. The configuration of the valve assembly is as shown in FIG. 7.

The user initiates the process of delivering material from the above-described conditions, by activating material pump control switch 60. As shown by FIG. 8, the signal from material pump control switch 60, rather than being sent directly to the material pump (not shown) as would occur in the absence of the present invention, is instead intercepted by solenoid connector 61 and sent generally to the control system. The operator signal is received by electrical timer 23, and then immediately by pneumatic control valve solenoid 7. Pneumatic control valve solenoid 7 then acts upon pneumatic control valve 11, opening breather vent 13.

By opening breather vent 13, some of the air in the pneumatic system is removed from that portion of the pneumatic system that is between quick exhaust valve 33 and pneumatic control valve 11, or the air that is on the "backside" of quick exhaust valve 33. After a sufficient amount of this air is exhausted, there is insufficient air pressure on the backside of quick exhaust valve to withstand the pressure from the "front" side or the side of the exhaust valve 33 exposed to the air from inflatable bladder 36. With insufficient air pressure on the backside, quick exhaust valve 33 opens, and most of the air in inflatable bladder 36 is expelled through quick exhaust valve 33 to the atmosphere or other suitable place. There are other means known in the art to quickly deflate inflatable bladder 36, and such means are within the scope of this invention. Once the air in inflatable bladder 36 is deflated, there is no longer a constriction in delivery hose 50 and material is free to flow out delivery hose 50 to the intended destination. The valve assembly at this point is as shown in FIG. 3.

After a sufficient amount of time has passed to complete the deflation activities described above, as determined and controlled by the setting of electrical timer 23, a signal is sent from electrical timer 23 to material pump signal input 62, thus activating material pump (not shown). Material pump (not shown) thus pumps concrete to the boom assembly, past hose cuff assembly 30, and out of the end of material discharge hose 50 to its intended destination.

The setting of electrical timer 23 thus introduces a delay in the concrete delivery control system of the present invention which ensures that concrete is free to flow out material discharge hose 50 before material pump (not shown) begins pumping material. As a result, there is a reduced likelihood that material pump (not shown) will force material into a closed material discharge hose 50, a situation which could result in extremely dangerous conditions to the people or property in the vicinity. Although the preferred embodiment of the present invention includes a five-second time delay set by the manufacturer, an alternative embodiment includes a variable delay control mechanism, which will allow the user to specify the amount of delay time to suit his particular needs, within the scope of the present invention. Such an embodiment may be particularly useful for long vertical drops of concrete, when the present invention is used in conjunction with pouring concrete underwater, or in other circumstances well known to those in the art.

Returning to the description of the concrete delivery cycle, after the intended amount of concrete has been delivered to the destination, the user stops the flow of concrete. The stopping process begins by the user sending a deactivation signal to material pump control switch 60. As before, this signal is intercepted by electrical timer 23, which immediately sends the deactivation signal to material pump signal input 62, thus turning material pump (not shown) off and stopping the pumping of concrete. Electrical timer 23 also sends a signal to pneumatic control valve solenoid 7, which opens pneumatic control valve 11, thus allowing compressed air from air pressure regulator 4 to flow to inflatable bladder 36. Once inflated, inflatable bladder 36 will block the flow of concrete through material discharge hose 50, thereby completing that pumping cycle.

There may be instances in which the user does not wish to utilize the present invention, but also does not wish to have to rewire the machinery. In such situations, the user may, in addition to placing the delay/no delay into the "no delay" position, also turn off the supply of compressed air to the present invention. In such an arrangement, the user may use the boom pump truck as if the present invention were not installed.

3. Airflow Process

The operation of the preferred embodiment may also be understood by considering the path of compressed air flow throughout the various components when the present invention is used. As can be seen in FIG. 7, air from compressed air supply 1 enters the system of the present invention by first flowing past air lockout mechanism 2. When the device is in operation, air lockout mechanism 2 is in the "open" position, whereas when maintenance is necessary, the worker's safety can be ensured by closing the air lockout mechanism 2.

From air lockout mechanism 2, air next flows to air particulate filter 3, where the air is filtered to remove particulates and water. After filtration, air then flows to air pressure regulator 4. In the preferred embodiment, air filter 3 and air pressure regulator 4 are a combined particulate filter/regulator, model number P14B-02GM, manufactured by Numatics® of Lapeer, Mich. In alternative embodiments, air pressure regulator 4 may be upstream of air particulate filter 3.

Air pressure regulator 4 is set to control the pressure of the air in the pneumatic portions of the present invention, including the tubing and the inflatable bladder, as described herein. The regulator may be adjusted based upon the size and type of material which is used to construct discharge hose 50. For safety reasons described herein, regulator 4 is set at the minimum pressure needed to inflate the inflatable bladder 36 in the preferred method of operation.

After the air leaves air pressure regulator 4, it then flows to pneumatic control valve 11, which is controlled by pneumatic control valve solenoid 7. Pneumatic control valve solenoid 7 is configured as "fail-to-close", whereby it is meant that upon any loss of power or signal failure, pneumatic control valve 11 is configured such that air will not be released from the air system; only upon pneumatic control valve solenoid 7 being energized, will air be permitted to discharge from the air system. As is discussed in more detail in the next section, such an arrangement gives rise to significant safety advantages.

In the preferred embodiment, air from pneumatic control valve 11 flows to tee 31 located in the vicinity of hose cuff assembly 30. Also connected to tee 31, and thus the entire pneumatic system of the present invention, is air pressure relief valve 32 which protects inflatable bladder 36 from failing due to excessive pressure. Under normal operation, compressed air flows from tee 31 to quick exhaust valve 33, then to inflatable bladder inlet 41 and finally into the interior of inflatable bladder 36.

Although the preferred embodiment described herein has certain components located at certain positions within a pneumatic system, it is to be understood that the present invention is intended to encompass systems in which the various locations of components may be located at different positions in relation to each other. As such, the present invention encompasses valve systems having a pneumatic system comprising various components which may be located at different points in relation to each other, provided that all such components are in pneumatic connection. Such a pneumatic system would include, at a minimum, an inflatable bladder and a pneumatic control valve; and optionally a quick exhaust valve, a relief valve, a breather vent, an air lockout mechanism, an air particulate filter, an air pressure regulator, and pneumatic tubing and connections. The various combinations and locations of such components, which would be operational and would fall within the scope of the present invention, would be apparent to those knowledgeable in the art.

4. Advantages of the Present Invention

It may thus be appreciated that the present invention includes many control and safety benefits previously unavailable to the concrete pumping industry. For example, having the pneumatic control valve 11 operated by the same signal as material pump (not shown) allows for a greatly reduced possibility that the pump will be activated when the inflatable bladder 36 is filled with air, and thus constricting discharge hose 50.

Another benefit of the present invention arises from the configuration of the pneumatic system so as to prevent the flow of concrete in the event of a power failure. Specifically, pneumatic control valve solenoid 7 is configured such that a signal is required to release the compressed air from inflatable bladder 36. As a result, should a power failure occur, the compressed air will remain in the inflatable bladder 36, thus preventing concrete from being released inadvertently and possibly injuring unsuspecting workers or damaging other equipment. Likewise, if the inflatable bladder 36 of the present invention is not filled with compressed air at the time of a power failure, then such power failure will result in pneumatic control valve solenoid 7 of the present invention opening, thus allowing air to fill the inflatable bladder 36.

Yet another safety benefit is the physical configuration of the solenoid connector terminals, as described above, which prevents the present invention from being connected to an existing material pump system in an incorrect manner.

Another safety advantage of the present invention is the use of a quick exhaust in the pneumatic system. A quick exhaust ensures that inflatable bladder 36 is substantially deflated prior to the start of pumping the material, thus reducing the possibility that the flow of concrete will burst the inflatable bladder 36 or discharge hose 50 because the air evacuates too slowly. Similarly, the use of an air pressure relief valve 32 in the pneumatic system of the present invention provides extra safety against overpressurization which may arise from a variety of causes.

A different, yet related, safety advantage of the present invention arises from the use of an air pressure regulator 4 which is adjustable. Being adjustable, air pressure regulator 4 allows the operator to modify the air pressure setting to coincide with the diameter and material of construction of discharge hose 50. By setting air regulator 4 at the minimum pressure required to inflate bladder 36 there is included an additional safety feature. Specifically, should quick exhaust valve 31 become plugged, and pressure release valve 32 also fail, then the use of the minimum pressure needed to fill inflatable bladder 36 with air will reduce the likelihood that inflatable bladder 36 will rupture when material pump (not shown) resumes pumping. Rather, in such failure mode, the use of the minimum pressure required to fill inflatable bladder 36 will likely result in the pressure of the material in discharge hose 50 being sufficient to open inflatable bladder 36 enough to allow material to resume flow, yet not rupture inflatable bladder 36.

In addition, the "delay" aspect allows several advantages not heretofore known in the art. In addition to the safety benefits previously discussed, the delay also allows for more precise control over the amount of material discharged, an advantage which will be appreciated by any operators who have attempted to "tip off" a pour without the present invention.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and embodiments are intended to be included within the scope of the dependent claims. It should be noted that the various elements of the present invention may be used to achieve the purposes described herein alone or in combination. Also, it should be noted that neither a discharge hose nor a material pump assembly are intended to be claimed elements of the present invention, but such references are only intended to describe the structure in which the invention is used, and not the structure of the present invention.

What is claimed is:

1. A valve apparatus for controlling the discharge of material pumped by a material pump through a discharge hose, said valve apparatus comprising:

(a) a casing;

(b) a bladder;

(c) said bladder being flexible;

(d) said casing substantially surrounding said bladder;

(e) said bladder encompassing at least a portion of an outer perimeter of the discharge hose;

(f) a compressed gas supply;

(g) a pneumatic control valve;

(h) said pneumatic control valve being in pneumatic connection with said compressed gas supply and said bladder;

(i) a quick exhaust valve;

(j) said quick exhaust valve being in pneumatic connection with said bladder;
(k) a breather vent;
(l) said breather vent being in pneumatic connection with said pneumatic control valve;
(m) said pneumatic control valve controlling the flow of compressed gas from said compressed gas supply into said bladder, and causing said bladder to expand, such expansion constricting the discharge hose; and
(n) said pneumatic control valve further controlling the flow of compressed gas from said bladder, such flow unconstricting the discharge hose.

2. The valve apparatus of claim 1 wherein said compressed gas supply comprises air.

3. The valve apparatus of claim 2 further comprising means for simultaneously controlling the operation of said pneumatic control valve and the material pump.

4. The valve apparatus of claim 2 further comprising:
(a) a pneumatic control valve solenoid;
(b) said pneumatic control valve solenoid acting upon said pneumatic control valve;
(c) said pneumatic control valve solenoid being in electrical connection with the material pump; and
(d) said pneumatic control valve solenoid and the material pump receiving and being operated upon by a single signal.

5. The valve apparatus of claim 4 further comprising:
(a) a first signal;
(b) a second signal;
(c) said first signal acting upon said pneumatic control valve to discharge compressed gas from said bladder;
(d) said first signal further activating the material pump to pump material;
(e) said second signal acting upon said pneumatic control valve to direct compressed gas into said bladder; and
(f) said second signal further deactivating the material pump to cease pumping material.

6. The valve apparatus of claim 5 wherein said first signal and said second signal are received from a material pump control switch.

7. The valve apparatus of claim 6 further comprising means for introducing a delay between said first signal being received by said pneumatic control valve solenoid and said first signal being received by the material pump.

8. The valve apparatus of claim 6 further comprising:
(a) an electrical timer;
(b) said electrical timer being in electrical connection with the material pump and said pneumatic control valve solenoid; and
(c) wherein said electrical timer introduces a delay in said first signal to the material pump signal input.

9. The valve apparatus of claim 8 further comprising:
(a) a timer bypass switch;
(b) said timer bypass switch being in electrical connection with said pneumatic control valve solenoid, said timer, and the material pump; and
(c) said timer bypass switch allowing the user to elect to introduce a delay or not introduce a delay in said first signal to the material pump.

10. The valve apparatus of claim 3 wherein said pneumatic control valve prevents the flow of material through a discharge hose upon the loss of any electrical power to said pneumatic control valve.

11. A valve apparatus for controlling the discharge of material pumped by a material pump through a discharge hose, said valve apparatus comprising:
(a) a casing;
(b) a bladder;
(c) said bladder being flexible;
(d) said casing substantially surrounding said bladder;
(e) said bladder encompassing at least a portion of an outer perimeter of the discharge hose;
(f) a compressed gas supply;
(g) a pneumatic control valve;
(h) said pneumatic control valve being in pneumatic connection with said compressed gas supply and said bladder;
(i) a relief valve;
(j) said relief valve being in pneumatic connection with said bladder;
(k) said pneumatic control valve controlling the flow of compressed gas from said compressed gas supply into said bladder and causing said bladder to expand, such expansion constricting the discharge hose; and
(l) said pneumatic control valve further controlling the flow of compressed gas from said bladder, such flow unconstricting the discharge hose.

12. The valve apparatus of claim 11 further comprising means for simultaneously controlling the operation of said pneumatic control valve and the material pump.

13. The valve apparatus of claim 11 further comprising:
(a) a pneumatic control valve solenoid;
(b) said pneumatic control valve solenoid acting upon said pneumatic control valve;
(c) said pneumatic control valve solenoid being in electrical connection with the material pump; and
(d) said pneumatic control valve solenoid and the material pump receiving and being operated upon by a single signal.

14. The valve apparatus of claim 13 further comprising:
(a) a first signal;
(b) a second signal;
(c) said first signal acting upon said pneumatic control valve to discharge compressed gas from said bladder;
(d) said first signal further activating the material pump to pump material;
(e) said second signal acting upon said pneumatic control valve solenoid to direct compressed gas into said bladder; and
(f) said second signal further deactivating the material pump to cease pumping material.

15. The valve apparatus of claim 14 wherein said first signal and said second signal are received from a control switch.

16. The valve apparatus of claim 15 wherein the control switch introduces delay between said first signal being received by said pneumatic control valve solenoid and said first signal being received by the material pump.

17. The valve apparatus of claim 15 further comprising:
(a) an electrical timer;
(b) said electrical timer being in electrical connection with the material pump and said pneumatic control valve solenoid; and
(c) wherein said electrical timer introduces a delay before transmitting said first signal to the material pump.

18. The valve apparatus of claim 17 further comprising:
(a) a timer bypass switch;
(b) said timer bypass switch being in electrical connection with said pneumatic control valve solenoid, said timer, and the material pump; and
(c) said timer bypass switch allowing the user to elect to introduce a delay or not introduce a delay before transmitting said first signal to the material pump.

19. The valve apparatus of claim 12 wherein said pneumatic control valve prevents the flow of material through discharge hose upon the loss of any electrical power to said pneumatic control valve solenoid.

20. A valve apparatus for controlling the discharge of material pumped by a material pump through a discharge hose, said valve apparatus comprising:

(a) a casing;
(b) a bladder;
(c) said bladder being flexible;
(d) said casing substantially surrounding said bladder;
(e) said bladder encompassing at least a portion of an outer perimeter of the discharge hose;
(f) a compressed gas supply;
(g) a pneumatic control valve;
(h) said pneumatic control valve being in pneumatic connection, with said compressed gas supply and said bladder;
(i) a quick exhaust valve;
(j) said quick exhaust valve being in pneumatic connection with said bladder;
(k) a breather vent;
(l) said breather vent being in pneumatic connection with said pneumatic control valve;
(m) a relief valve;
(n) said relief valve being in pneumatic connection with said bladder;
(o) said pneumatic control valve controlling the flow of compressed gas from said compressed gas supply into said bladder and causing said bladder to expand, such expansion constricting the discharge hose; and
(p) said pneumatic control valve further controlling the flow of compressed gas from said bladder, such flow unconstricting the discharge hose.

21. The valve apparatus of claim 20 wherein said compressed gas supply comprises air.

22. The valve apparatus of claim 21 further comprising means for simultaneously controlling the operation of said pneumatic control valve and the material pump.

23. The valve apparatus of claim 21 further comprising:

(a) a pneumatic control valve solenoid;
(b) said pneumatic control valve solenoid acting upon said pneumatic control valve;
(c) said pneumatic control valve solenoid being in electrical connection with the material pump; and
(d) said pneumatic control valve solenoid and the material pump receiving and being operated upon by a single signal.

24. The valve apparatus of claim 23 further comprising:

(a) a first signal;
(b) a second signal;
(c) said first signal acting upon said pneumatic control valve solenoid to discharge compressed gas from said bladder;
(d) said first signal further activating the material pump to pump material;
(e) said second signal acting upon said pneumatic control valve solenoid to direct compressed gas into said bladder; and
(f) said second signal further deactivating the material pump to cease pumping material.

25. The valve apparatus of claim 24 wherein said first signal and said second signal are received a control switch.

26. The valve apparatus of claim 25 further comprising means for introducing a delay between said first signal being received by said pneumatic control valve and said first signal being received by the material pump.

27. The valve apparatus of claim 25 further comprising:

(a) an electrical timer;
(b) wherein said electrical timer is in electrical connection with the material pump and said pneumatic control valve solenoid;
(c) wherein said electrical timer introduces a delay before transmitting m said first signal to the material pump.

28. The valve apparatus of claim 27 further comprising:

(a) a timer bypass switch;
(b) said timer bypass switch being in electrical connection with said pneumatic control valve solenoid, said timer, and the material pump; and
(c) said timer bypass switch allowing the user to elect to introduce a delay or not introduce a delay before transmitting said first signal to the material pump.

29. The valve apparatus of claim 22 wherein said pneumatic control valve prevents the flow of material through discharge hose upon the loss of any electrical power to said pneumatic control valve.

30. A valve apparatus for controlling the flow of concrete from a system having a material pump and a discharge hose, where the material pump has a control switch and a signal input, said valve apparatus comprising:

(a) a casing;
(b) said casing being metal;
(c) a flexible bladder;
(d) said bladder being rubber;
(e) said bladder being tube-shaped and having first and second ends;
(f) said bladder being located substantially within said casing;
(g) said bladder being located to at least substantially surround the outer perimeter of the discharge hose;
(h) a compressed air supply;
(i) said bladder first and second ends being sealed so as to permit said bladder to hold compressed air;
(j) said bladder expanding upon being filled with compressed air from said compressed air supply, such expansion constricting the discharge hose;
(k) said bladder further substantially deflating upon removal of compressed air, such deflation unconstricting the discharge hose;
(l) a quick exhaust valve;
(m) a pressure relief valve;
(n) a pneumatic control valve;
(o) a breather vent;
(p) an air pressure regulator;
(q) an air filter;
(r) said quick exhaust valve, said pressure relief valve, said pneumatic control valve, said breather vent, said air pressure regulator, and said air filter being in pneumatic connection with said bladder;
(s) a pneumatic control valve solenoid;
(t) said pneumatic control valve solenoid operating upon said pneumatic control valve;
(u) said pneumatic control valve solenoid being configured in relation to said pneumatic control valve so as to require a signal to be received from the material pump control switch in order to actuate said pneumatic control valve and allow compressed air to be discharged from said breather vent;
(v) a timer;
(w) a timer bypass switch;
(x) a pump solenoid connector, including a male positive pin, a male negative pin, a female positive pin, and a female negative pin;

(y) said male positive pin being in electrical connection with said pneumatic control valve solenoid, said electrical timer, said timer bypass switch, and said female positive pin;

(z) said female negative pin being in electrical connection with said male negative pin and said pneumatic control valve solenoid;

(aa) one or more casing supports;

(bb) said one or more casing supports being located on said casing;

(cc) one or more support mechanisms;

(dd) wherein said one or more casing supports accept said one or more support mechanisms to provide physical support for said casing; and (ee) wherein said one or more support mechanisms are adjustable to allow for movable positioning of the casing along the discharge hose.

31. A valve apparatus for controlling the discharge of material through a flexible hose, comprising:

a rigid outer tube having an inner surface;

a sealed bladder comprising a flexible tube having a first open end and a second open end opposite of the first open end and at least one sealing plate, wherein the at least one sealing plate is coupled to the rigid outer tube such that the first open end and the second open end are clamped shut against the inner surface of the rigid tube and the sealed bladder is surrounded by the rigid outer tube and the inner surface of the rigid outer tube rigidly prevents radially outward expansion of the bladder;

an inlet valve for introducing a compressed gas into the bladder;

an outlet valve for quickly releasing the compressed gas from the bladder; and a control, wherein the bladder is capable of radially inwardly expansion, when the control opens the inlet valve.

* * * * *